US005877461A

United States Patent [19]

Karlsson et al.

[11] Patent Number: 5,877,461

[45] Date of Patent: Mar. 2, 1999

[54] MUFFLER

[75] Inventors: Egon Karlsson, Jönköping; Kent Ludvigsson, Tenhult; Stefan Stark, Huskvarna, all of Sweden

[73] Assignee: Aktiebolaget Electrolux, Stockholm, Sweden

[21] Appl. No.: 894,851

[22] PCT Filed: Feb. 14, 1996

[86] PCT No.: PCT/SE96/00191

§ 371 Date: Aug. 11, 1997

§ 102(e) Date: Aug. 11, 1997

[87] PCT Pub. No.: WO96/25590

PCT Pub. Date: Aug. 22, 1996

[30] Foreign Application Priority Data

Feb. 14, 1995 [SE] Sweden ..... 9500523

[51] Int. Cl.[6] ..... F01N 3/02

[52] U.S. Cl. ..... 181/230; 181/231

[58] Field of Search ..... 181/230, 231, 181/255, 269, 282, 240

[56] References Cited

U.S. PATENT DOCUMENTS

| | | | |
|---|---|---|---|
| 3,650,354 | 3/1972 | Gordon | 181/230 |
| 3,798,769 | 3/1974 | Bailey . | |
| 4,142,607 | 3/1979 | Landwehr et al. | 181/240 |
| 4,231,221 | 11/1980 | Mathner et al. | 181/240 |
| 4,286,675 | 9/1981 | Tuggle . | |
| 4,370,855 | 2/1983 | Tuggle . | |
| 4,846,301 | 7/1989 | Granath et al. . | |
| 5,177,962 | 1/1993 | Hall et al. . | |
| 5,315,075 | 5/1994 | Junginger et al. . | |

*Primary Examiner*—Khanh Dang
*Attorney, Agent, or Firm*—Pearne, Gordon, McCoy & Granger LLP

[57] ABSTRACT

Muffler (1) for portable working tools, preferably chain saws (2), whereby the muffler is mounted directly onto the cylinder's (16) exhaust gas outlet (3). The muffler's (1) exhaust gas outlet (4) is positioned on an upper side (5) of the muffler, i.e. a side which is turned in the same direction as the cylinder's (16) upper side, and the muffler's exhaust gas outlet (4) is equipped with a deflecting device (6), for instance a bent tube, which deflects the exhaust gas flow (7), so that this leaves the muffler in a plane which is parallel to the muffler's upper side (5). The figure shows the chain saw schematically, without protective covers, guide bar and chain. Its cooling fan (19) blows cooling air (20) over the cylinder and the muffler. The positioning and the design of the exhaust gas outlet facilitate a very favorable dilution of the exhaust gases with the cooling air.

9 Claims, 5 Drawing Sheets

MUFFLER

TECHNICAL FIELD

The subject invention refers to a muffler for portable working tools, particularly chain saws at which the muffler is directly mounted to the exhaust gas outlet of the cylinder.

BACKGROUND OF THE INVENTION

The muffler for portable working tools is usually directly mounted to the cylinder's exhaust gas outlet as compactly as possible. For these tools there is a very strong demand for a low total weight and small size. This leads to a demand for a small and light muffler, which at the same time gives a satisfactory silencing function. It is also important that the user does not get injured if he comes into contact with the tool's muffler or its exhaust gases. Furthermore, it is obviously important that the exhaust gases do not set fire to adjacent objects, for example grass or twigs in the case of a chain saw. This has lead to the existence of special legal requirements concerning the muffler's surface contact temperature and the exhaust gas temperature in the vicinity. The working tool is usually supplied with a cooling fan and various safety covers around the cylinder and partly around the muffler. It is desirable to achieve a good mix of the exhaust gases in the cooling-air to reduce the temperature. However, in reality this is hard to achieve due to lack of space and with regard to weight.

PURPOSE OF THE INVENTION

The purpose of the subject invention is to substantially reduce the above outlined problems.

SUMMARY OF THE INVENTION

The above purpose is achieved in a muffler in accordance with the invention having the characteristics appearing from the appended claims.

The muffler in accordance with the invention is thus essentially characterized in that the muffler's exhaust gas outlet is located on an upper side of the muffler, i.e. a side which is turned in the same direction as the upper side of the cylinder, i.e. turned away from the engine's crankcase. Furthermore, the muffler's exhaust gas outlet is supplied with a deflecting device, for instance a bent tube, which deflects the exhaust gas flow, so that it leaves the muffler in a plane which is relatively parallel to the upper side of the muffler. By locating the exhaust gas outlet on the upper side of the muffler it is made possible to take advantage of the large amount of cooling air, which usually blows over the upper sides of the cylinder and muffler. Hereby an effective mix of exhaust gases and cooling-air can take place, assuming that a deflecting device directs the exhaust gases relatively parallel to the upper side of the muffler. Problems with space and temperature have most likely lead to that this solution has not previously been used, as far as the applicant is aware of. According to a further development of the preferred embodiment of the invention the exhaust gas outlet is shaped and directed so that a substantial part of the exhaust gases flow sideways across the muffler's upper side. This contributes to a good mix of exhaust gases and cooling-air and to a lower temperature around the tool. Further characteristics and advantages of the invention will be apparent from the ensuing description of preferred embodiments and with the support of the drawing figures.

BRIEF DESCRIPTION OF THE DRAWINGS

The invention will be described in closer detail in the following by way of various embodiments thereof with reference to the accompanying drawing figures.

DESCRIPTION OF EMBODIMENTS

Figure 1:
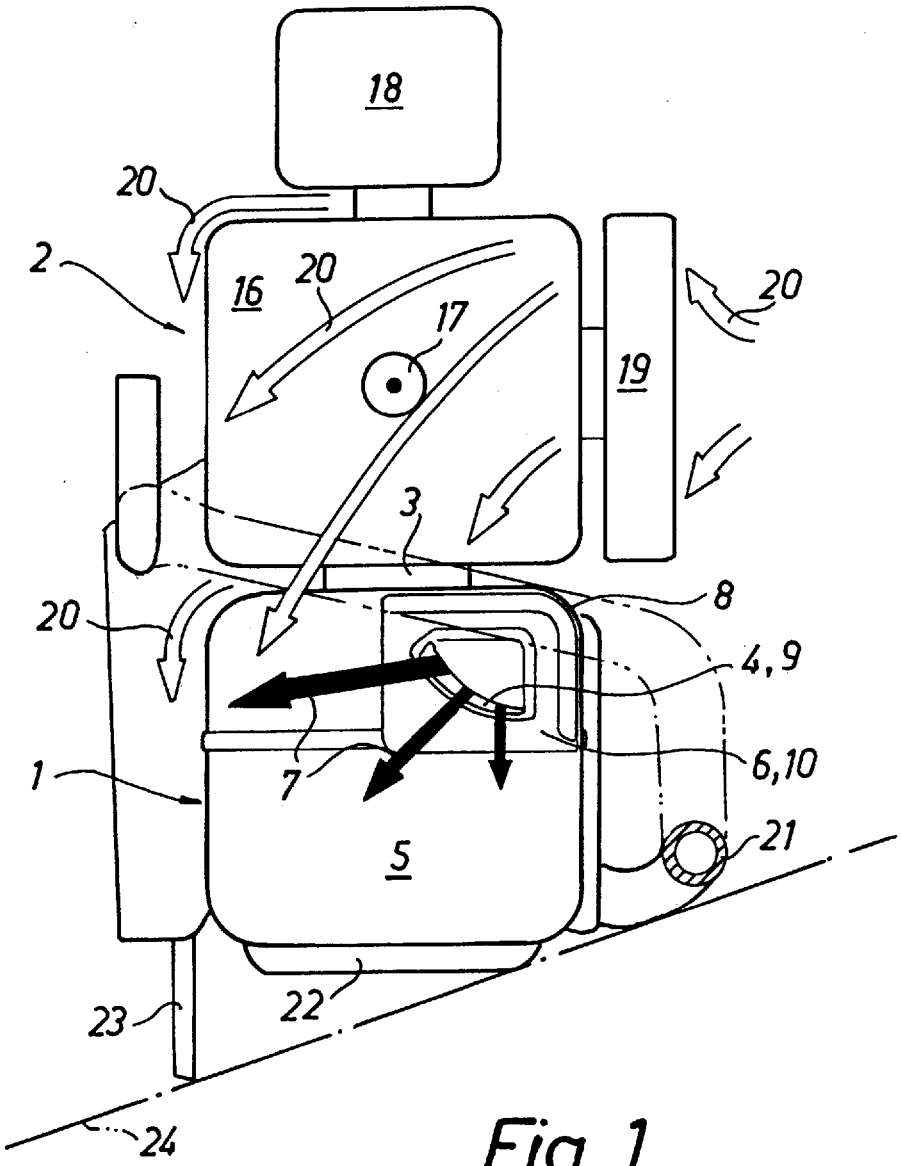
FIG. 1 shows a chain saw schematically seen from above. The saw's guide bar and chain as well as various safety covers have been removed, to more clearly show the muffler and its cooling.

In FIG. 1, numeral reference 1 designates a muffler, which is directly mounted to the cylinder's 16 exhaust gas outlet 3. We see the chain saw straight from above down towards the cylinder's 16 upper side with spark plug 17. Next to the cylinder a carburetor 18 is located, on the opposite side of the muffler 1. The chain saw 2 is air-cooled and its cylinder 16 has suitably square cooling fins, as illustrated in the figure. The upper side of the cylinder 16 and the muffler 1 are approximately on the same level. A cooling fan 19 blows cooling air around and over the cylinder 16. The air flow is steered by protective covers, which are not shown here. That means that a protective cover on the upper side covers the cylinder and a part of the muffler.

As illustrated by the cooling air arrows 20, some of the cooling air flows around the cylinder 16 and also between the cylinder and the muffler 1. A large portion of the cooling air flows across the cylinder 16 and further towards the muffler 1. The muffler's exhaust gas outlet 4 is located on an upper side 5 of the muffler, i.e. a side which is turned in the same direction as the cylinder's 16 upper side, i.e. turned away from the engine's crankcase. The muffler's exhaust gas outlet 4 has a deflecting device 6, for instance a bent tube, which deflects the exhaust gas flow 7, so that it leaves the muffler in a plane which is relatively parallel to the muffler's upper side 5.

The amount of cooling air is approximately 10 times greater than the amount of exhaust gas and it is important to achieve a good mix of exhaust gas and cooling air. The exhaust gas outlet 4 is located close to a corner 8 of the muffler situated close to the cylinder. The corner 8, which is closest to the cooling fan 19, is suitably chosen. The exhaust gas outlet is shaped and directed so that a considerable part of the exhaust gas flows sideways over the muffler's upper side 5, i.e. across the direction of the cylinder's exhaust gas outlet 3. The deflecting device 6 is designed so that it expands sideways and consequently spreads the exhaust gases sideways. This device is designed so that the exhaust gases spread in a sector from 60 to 120 degrees and preferably around 90 degrees. In the illustrated embodiment the spread is around 90 degrees, but even the amount of exhaust gases vary in the different directions. For, the deflecting device 6 has a throttling 9 in the outlet 4. This throttling varies sideways and it is larger in the muffler's longitudinal direction than in its sideways direction. Consequently a larger amount of exhaust gas flows in the muffler's sideways direction than in its longitudinal direction. This is suitable considering the mix of exhaust gases in the cooling air 20.

When using the saw practically it is important that the exhaust gases do not set fire to for instance twigs in the vicinity, or cause any injuries to the user. Formally there are also existing legal requirements both concerning the surface contact temperature and the maximum temperature of the exhaust gas in the so called roll plane. The easiest way to understand the term roll plane is to imagine that the chain saw, without guide bar and chain, is driven and held against a plane surface in a large number of different angles. FIG. 1 shows an example of roll plane 24. In this case the saw is partly supported against its spiked bumper 23 and partly against a so called bumper 22 on the muffler 1. The bumper 22 is mounted in a strategic position on the front of the muffler, in order to move the roll plane outwards in many cases. The handle 21 of the chain saw as well as the spiked bumper 23 and the bumper 22 will in many cases constitute contact points against the roll plane. During the measurement the chain saw, in a specified condition without guide bar and chain, is rolled over a plane measuring table, after which measuring of maximum temperature takes place. Current legal requirements state that the maximum temperature of the exhaust gas must not exceed 247 degrees Celsius, which is hard to meet. Current legal requirements for surface contact temperatures is a maximum of 288 degrees C., which applies to points that come into contact with the roll plane, for example the bumper 22. These legal requirements applies in parts of the USA, Canada and Australia. As illustrated in FIG. 1 the majority of the exhaust gas flows sideways relative to the muffler and is mixed with cooling air 20. In this direction it is always far to the roll plane, even when it is at its closest. Only a minor amount of exhaust gas flows in the muffler's longitudinal direction, which is the direction in which the roll plane comes closest to the exhaust gas outlet.

Figure 2:
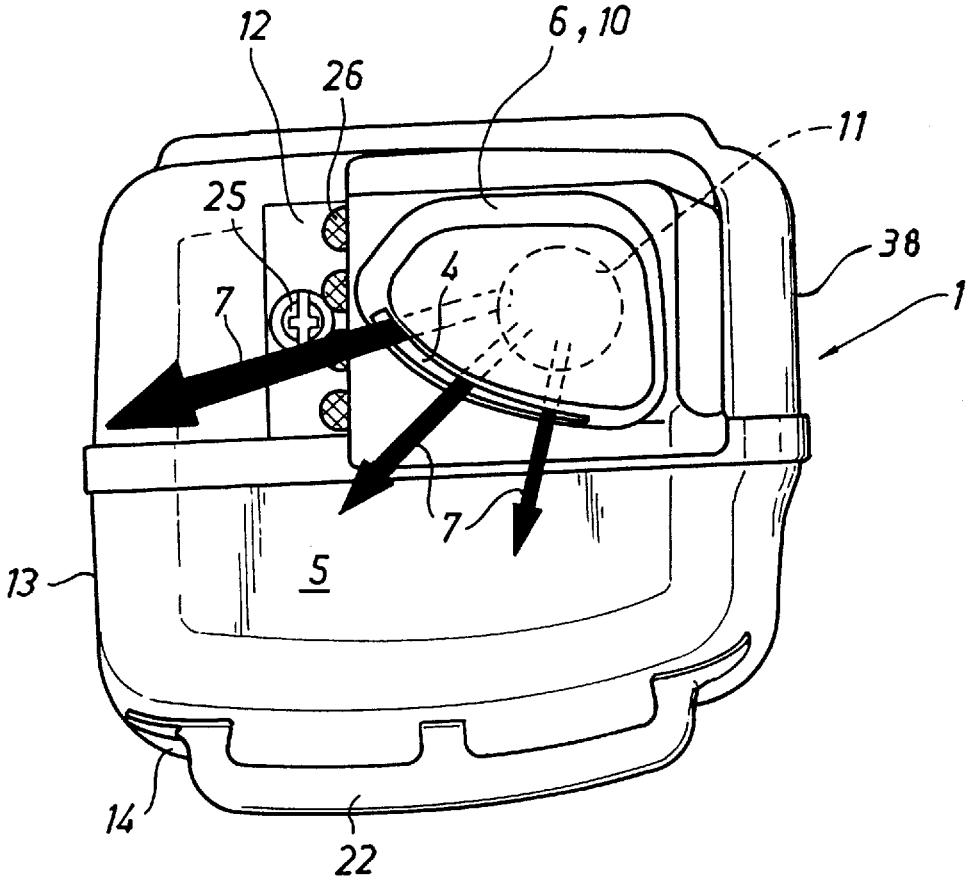
FIG. 2 shows the muffler in FIG. 1 from above, although in a larger scale and in more detail.
Figure 3:
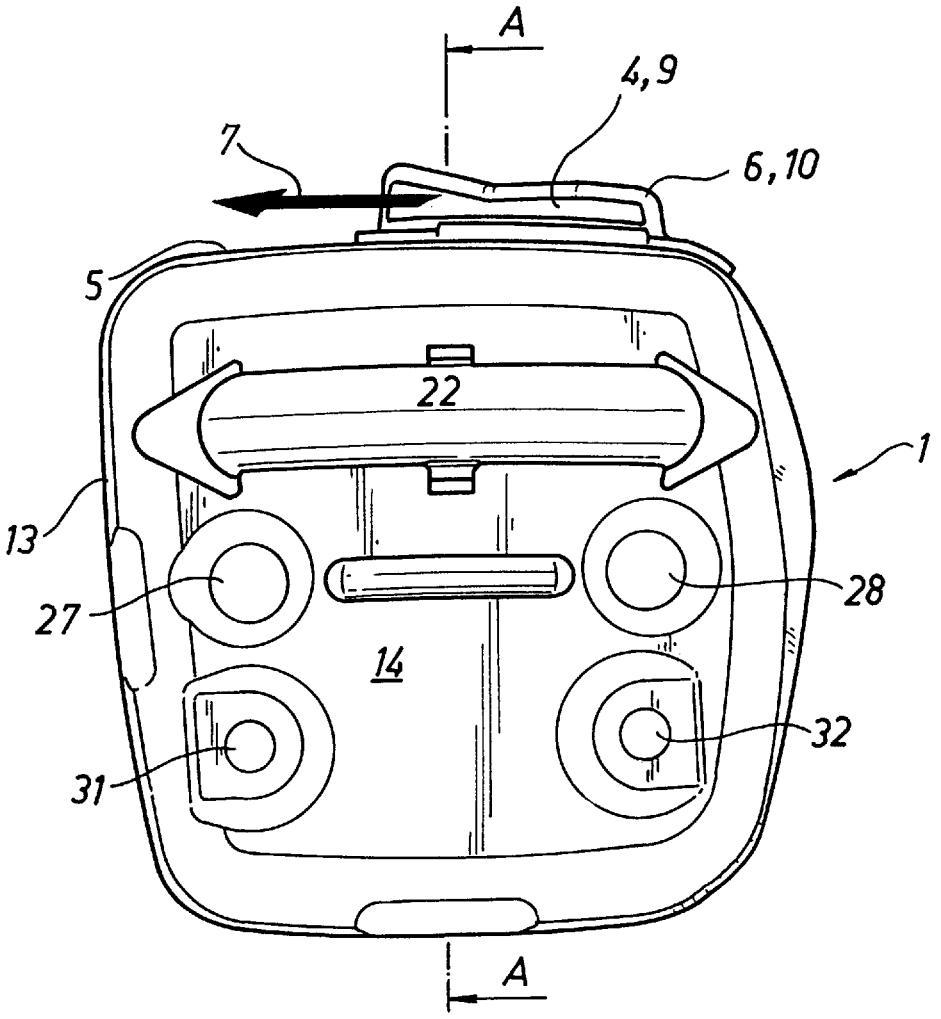
FIG. 3 shows the muffler in FIG. 2 from the front.
Figure 4:
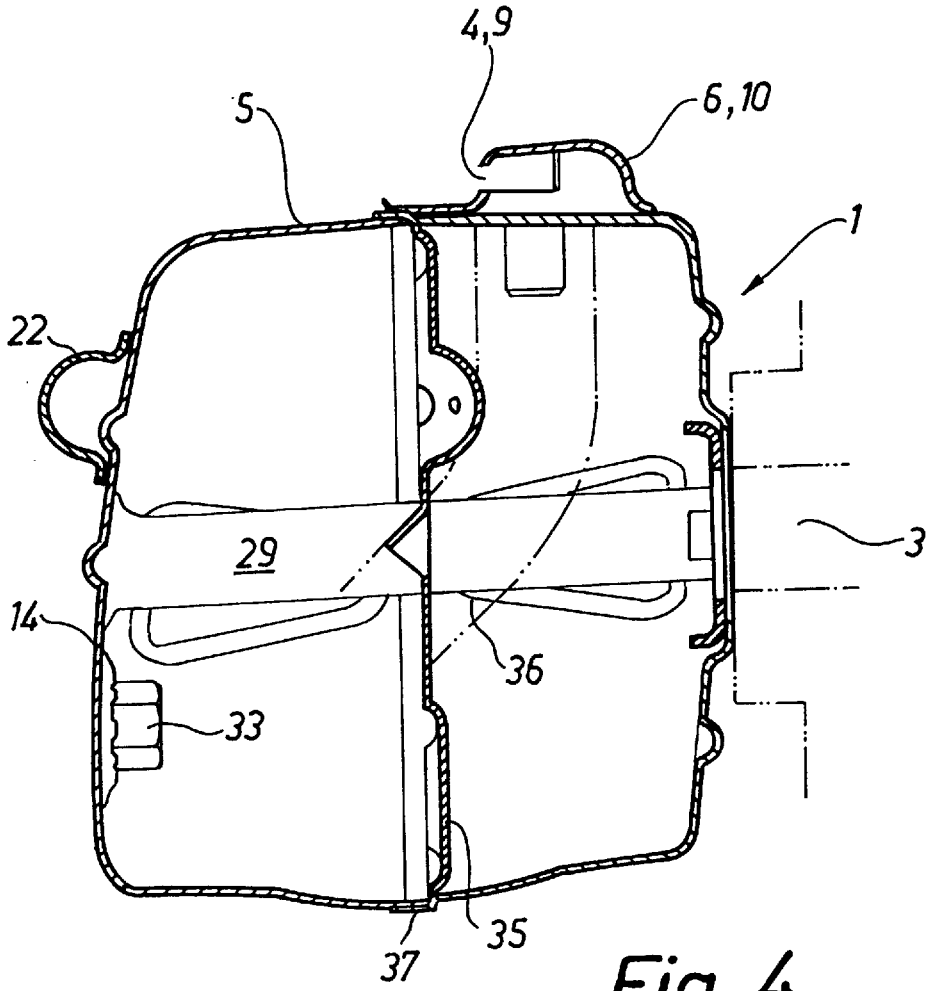
FIG. 4 shows a cross section of the muffler in the previous figures seen from the side along line A—A in FIG. 3.

FIGS. 2–4 show the muffler according to FIG. 1 enlarged and in more detail. Its main parts are illustrated in FIG. 2 seen from above. As illustrated in the figure the deflecting device 6 is designed in the form of a housing shaped body 10, which has an unbroken roof and walls supplied with outlet 4 for the exhaust gases. The housing shaped body 10 lacks flooring to certain extent, and is mounted to the muffler's upper side 5. This is supplied with a corresponding aperture 11, through which the exhaust gases penetrate into the deflecting device 6. The housing shaped body 10 is suitably manufactured by pressing in a tool. Along all edges but one, the plate is shaped so that it is adapted to the muffler's upper side 5. Thus along three sides, the housing shaped body touches the muffler's upper side, while it has an opening on the fourth side next to a pocket which is embodied between the body 10 and the muffler's upper side 5. A structure 12 comprising a spark arrester screen, is designed so that it can be inserted into the pocket. This implies that the exhaust gas flow 7 exits the aperture 11 on the upper side 5 of the muffler, thence passes the spark arrester screen and deflects in the housing shaped body 10 in order to flow out of its exhaust gas discharge 4.

FIGS. 2 and 3 show that the exhaust gas outlet 4 has a height which varies sideways and this height is smallest in the longitudinal direction and largest in the sideways direction. The outlet throttles the exhaust gases and the throttling is consequently higher in the muffler's longitudinal direction than in the sideways direction. The structure 12 is normally called a spark arrester screen. It partly contains a fastening device and partly a wire mesh or net. The fastening device can comprise a plate folded around a wire mesh. This plate is supplied with a fastening hole in which a fastening screw 25 is inserted and screwed tightly onto the muffler's upper side 5. A number of stampings 26 are embodied in the fastening device, in order to join this with the wire mesh or net in a safer way. Obviously, even the housing shaped body 10 could have an alternative primary form than the illustrated rectangular one and the aperture into the pocket can naturally take up a larger or smaller part than one side of its surrounding edge.

FIG. 3 shows the muffler from the front and FIG. 4 in cross section from the side along the line A—A. By comparing these two illustrations the muffler's construction becomes more clear. The bumper 22 is located on the highest part of the front, which previously has been described. As illustrated in FIG. 4, it consists of a profiled plate, which has been spot welded and/or soldered onto the muffler. Beneath there are two holes 27 and 28, which extends straight through the muffler and exits on both sides of the cylinder's exhaust gas outlet 3. Two distance tubes 29 and 30 surround these holes. The distance tubes are soldered onto both sides inside the muffler. When screws are inserted into the holes and screwed down tightly in the corresponding screw holes on both sides of the cylinder's exhaust gas outlet 3, the distance tubes prevent the muffler from being deformed. They further prevent exhaust gases from leaking out of the front. Far down the front 14 there are two holes 31 and 32. On the inside of these holes there are nuts which are fastened by means of welding and/or soldering. These fastening holes are used for attaching a support bracket onto the muffler by means of screws. As illustrated in FIG. 4 the muffler is supplied with a baffle 35 which divides the total muffler volume into two parts. The exhaust gases exit the exhaust gas outlet 3 into the following part and consequently pass through apertures out into the next part of the muffler. From there the exhaust gases flow through a tube 36 to the muffler's deflecting device. The tube 36 is partly attached to the baffle 35 and partly to the muffler's upper side 5. The arrangement of having a baffle 35 and tube 36 is not necessary, but contributes to an improved noise reduction. The muffler's main parts are joined together at a joint 37 where the parts have been soldered together in a gas-proof sealed manner.

As illustrated in FIGS. 3 and 4, the transition from the upper side 5 to a vertical side 13, 14 is designed with an unusually large radius for these types of mufflers. The radius is suitably 5 to 15 mm and preferably about 10 mm. Hereby a well adapted spreading effect of the exhaust gas flow is obtained. A portion of the exhaust gas flow simply deflects and follows the radius transition fractionally downwards. By choosing a well adapted radius this spreading effect becomes optimal. If the radius is made even larger, the entire exhaust gas flow could then easily be deflected and if it is smaller, the exhaust gas flow is hardly deflected at all. This adapted rounding of the transition from the upper side to the vertical side contributes to reduce the exhaust gas temperature in the roll plane.

Within the scope of the invention, the muffler with its special exhaust gas outlet can be designed in many ways. As mentioned, the muffler can be short of a baffle 35 and it can be detachable so that firstly the inner part is screwed onto the cylinder's exhaust gas outlet 3 and after that, the outer part is screwed onto the inner part. Furthermore, the muffler can be equipped with a catalytic converter element to reduce the exhaust gas emissions. This could for instance be located in the illustrated tube 36, but also in many other ways.

Figure 5:
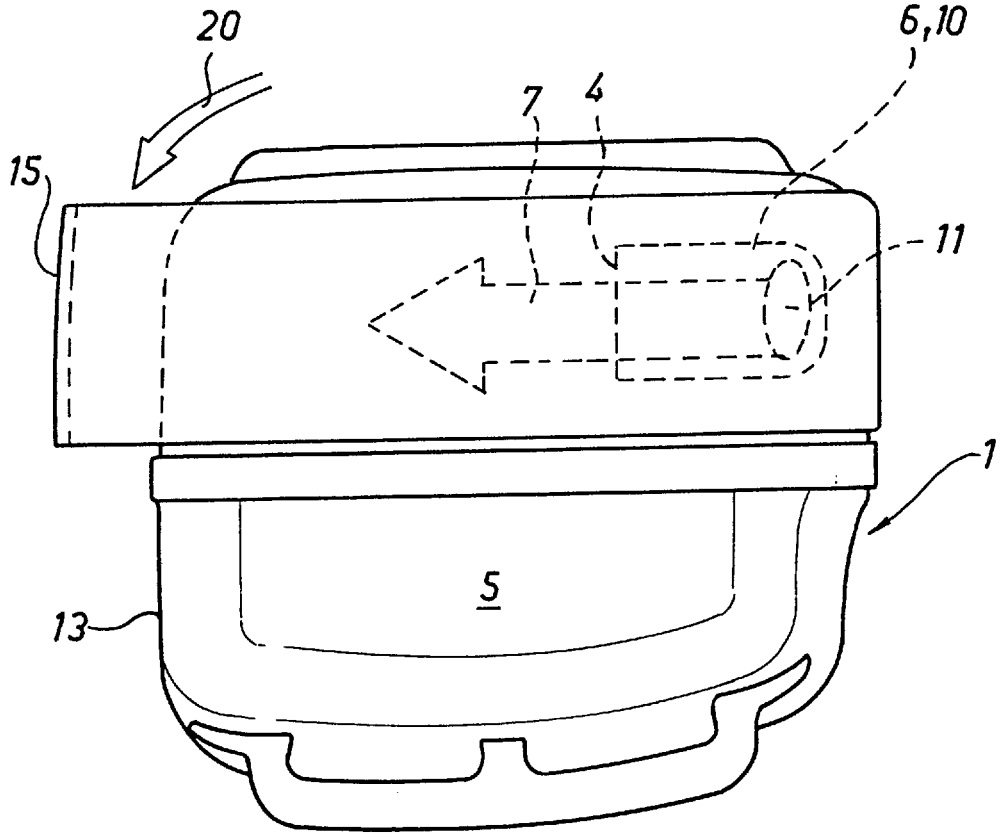
FIG. 5 shows a further preferred embodiment of a muffler according to the invention.

FIG. 5 illustrates a somewhat different embodiment of the invention than the one previously described. Also in this case, the muffler's exhaust gas outlet 4 is located on the upper side 5 of the muffler and supplied with a deflecting device 6, so that the exhaust gas flow leaves the muffler in a plane relatively parallel to the muffler's upper side 5. The muffler's exhaust gas outlet is also positioned close to a corner 8 of the muffler, situated close to the cylinder, suitably the corner which is closest to the cooling fan 19.

However, in this case the deflecting device 6 is designed and directed in a way so that it discharges a relatively concentrated exhaust gas flow in a sideways direction over the muffler. The deflecting device 6 is even in this case designed as a housing shaped body 10, but here it has a more oblong shape and exhaust gas outlet 4 only along one of the short sides. Along the remaining sides the body 10 is mounted to the upper side 5 of the muffler. An aperture 11 on the upper side 5 of the muffler leads the exhaust gases up into the housing shaped body 10. This aperture 11 connects close to the short side of the body 10, which is opposite the exhaust gas outlet 4. Through these measures a concentrated exhaust gas flow 7 is created. By the housing shaped body being directed so that its aperture 4 points sideways relative to the muffler, the exhaust gases flow in this direction.

A protective cover 15, suitably of metal, is mounted onto the muffler so that it extends above mainly the whole width of the upper side 5 and extends above the exhaust gas outlet 4. As illustrated in FIG. 5 the protective cover 15 is fastened at the same corner 8 as the deflecting device 6. It extends straight across the muffler and also down along the opposite side wall. As illustrated in the figure, cooling air 20 can blow between the protective cover 15 and the muffler 1 along the vertical side 13 of the muffler. Along the upper side 5 of the muffler, the protective cover is suitably designed so that cooling air 20 can pass in between the protective cover and the muffler on the side of the protective cover 15, which is closest to the cylinder. The opposite side of the protective cover can on the other hand be more or less closed in order to fit different applications.

In the embodiment according to FIG. 5 the protective cover extends down outside the side wall 13, towards which the exhaust gas outlet is directed. However, the protective cover 15 could also be so large that it covers the entire upper side 5 and extends down even along the front side 14. It could then even replace the bumper 22. Thus, the protective cover could extend downwards outside the side wall(s) against which the exhaust gas outlet is directed. Such a protective cover, with greater or lesser extension (FIG. 5), could also be used in combination with a muffler according to FIGS. 1 to 4.

A great advantage with the muffler according to the invention is that it facilitates a very effective mix of the exhaust gases with the cooling air 20, especially with the substantial cooling air flow which passes above the cylinder 16 and the muffler's upper side 5. Since it is usually very tight between the protective cover, which extends over the upper side of the cylinder and the muffler, other solutions are necessary in this case. This is due to the fact that the protective cover is usually made of temperature sensitive plastic material. One solution is to equip the muffler with the protective cover 15, as described above. The protective cover can of course be equipped with insulating material on its upper side to reduce the surface temperature. When the protective cover 15 is used, the normal plastic protective cover over the cylinder and muffler is shortened, so that it just reaches the muffler or extends only fractionally beyond the muffler. The chain saw is supplied with a front hand guard, which is not illustrated in the schematic FIG. 1. This front hand guard is positioned in front of the handle 21 and above the muffler 1. This front hand guard is suitably supplied with a protective part, which begins where the shortened plastic engine cover ends. Hereby the muffler according to FIGS. 1 to 4, can be used without problems. The front hand guard is also usually made of plastic, but it is located at a greater distance from the muffler, which is favourable. Such a front hand guard can obviously also be used in combination with a muffler according to FIG. 5 or similar, i.e. supplied with the protective cover 15. This is possible, but hardly necessary.

The muffler is supplied with an aperture 11 in the muffler's 1 upper side 5 or in a side wall 13, 38 and at least one deflecting device 6, 15, for instance a bent tube, is connected to the aperture 11 and deflects the engine's exhaust gas flow 7, so that it leaves the muffler in a plane which is relatively parallel with the muffler's 1 upper side 5, and thereby the muffler's exhaust gas outlet 4 is essentially arranged on an upper side 5 of the muffler. For instance, the aperture 11 can be positioned in a side wall 13, 38 and be supplied with a deflecting device in the form of a bent tube, which makes the exhaust gases flow along the side wall 13, 38 up towards the upper side 5. A protective cover 15, suitably made of metal, is mounted on the muffler, so that it extends above the exhaust gas outlet 4 at the mouth of the bent tube. Thus, the protective cover 15 extends relatively parallel with the side wall 13, 38 around the corner to the upper side 5 and relatively parallel with this, along the entire or a portion of its width. Thus, in this case, the protective cover 15 also functions as a deflecting device. The bent tube can of course also be drawn around the corner to the upper side 5. Preferably, the distance from the aperture 11 to the upper side 5 is small and the side wall 13, 38 leans upwards, i.e. the angle between these sides exceeds 90 degrees. On the contrary, it is unsuitable to locate the aperture 11 in the side, which is turned towards the cylinder. This would result in a substantial heating of the deflecting device and consequently the cylinder.

We claim:

1. A muffler (1) for portable working tools, preferably chain saws (2), said muffler (1) being directly mounted to an exhaust gas outlet (3) of a cylinder (16), said muffler comprising a plurality of side walls, a front wall, a lower wall, a rear wall facing the cylinder, and an upper wall, an aperture (11) is formed in said upper wall (5) or side wall (13, 38), at least one deflecting device (6, 15) is disposed over the aperture (11) and serves to deflect exhaust gas flowing through the aperture such that exhaust gas leaves the muffler, via a muffler exhaust gas outlet (4), and travels in a plane which is relatively parallel to the muffler upper wall (5), said muffler exhaust gas outlet (4) being designed and directed such that a substantial portion of the exhaust gases flow over the muffler upper wall (5) in a sideways direction, said sideways direction being generally at an angle to a direction of the cylinder exhaust gas outlet (3).

2. The muffler (1) in accordance with claim 1, wherein the muffler exhaust gas outlet (4) is positioned close to a corner (8) of the muffler (1), said corner (8) being situated close to the cylinder.

3. The muffler (1) in accordance with claim 1, wherein the deflecting device (6) expands sideways and serves to distribute the exhaust gases sideways, said deflecting device being designed so that the exhaust gases are spread out in a sector of between about 60–120 degrees.

4. The muffler (1) in accordance with claim 3, wherein the deflecting device has a throttling (9) at its outlet (4), said throttling varies sideways and is more substantial in a longitudinal direction of the muffler than in a sideways direction of the muffler, whereby a greater amount of exhaust gas exits in the sideways direction than in the longitudinal direction.

5. The muffler (1) in accordance with claim 1, wherein the deflecting device (6) comprises a housing shaped body (10), said body having an unbroken roof and walls defining the muffler exhaust gas outlet (4), said body being mounted to the muffler upper wall (5), said muffler upper wall defining the aperture (11) through which the exhaust gases flow into the deflecting device (6).

6. The muffler (1) in accordance with claim 5, wherein the housing shaped body (10) is fastened along only one portion of its surrounding edge and thereby defines an aperture into a pocket which is embodied between the body (10) and the muffler upper wall (5), and a structure (12), which contains a spark arrester screen, is adapted to be inserted into the pocket such that the exhaust gas flow (7) is forced to pass the spark arrester screen.

7. The muffler (1) in accordance with claim 1, wherein the deflecting device (6) is designed and directed to provide a relatively concentrated exhaust gas flow sideways over the muffler.

8. The muffler (1) in accordance with claim 1, wherein a protective cover (15) is mounted onto the muffler, said cover extending mainly above the whole width of the upper wall (5) and above the muffler exhaust gas outlet (4).

9. The muffler (1) in accordance with claim 8, wherein the protective cover (15) also extends downwards outside one of the muffler side walls towards which the muffler exhaust gas outlet is directed.

* * * * *